US005683037A

United States Patent [19]

Rochman et al.

[11] Patent Number: 5,683,037

[45] Date of Patent: Nov. 4, 1997

[54] ADHESIVE SPRAY GUN SYSTEM WITH INDIVIDUALLY ADJUSTABLE SPRAY MODULES

[75] Inventors: Timothy L. Rochman, Doraville; Bentley J. Boger, Atlanta; John M. Raterman, Lawrenceville, all of Ga.

[73] Assignee: Nordson Corporation, Westlake, Ohio

[21] Appl. No.: 366,820

[22] Filed: Dec. 30, 1994

[51] Int. Cl.[6] ..... B05B 15/08

[52] U.S. Cl. ..... 239/536; 239/566; 239/587.1; 239/600

[58] Field of Search ..... 239/536, 566, 239/587.1, 600

[56] References Cited

U.S. PATENT DOCUMENTS

| | | | |
|---|---|---|---|
| Re. 27,865 | 1/1974 | Baker et al. . | |
| Re. 33,481 | 12/1990 | Ziecker et al. . | |
| 4,760,961 | 8/1988 | Nagai | 239/536 |
| 4,815,660 | 3/1989 | Boger . | |
| 5,094,398 | 3/1992 | Jeter et al. . | |
| 5,265,800 | 11/1993 | Ziecker et al. . | |

*Primary Examiner*—Matthew C. Graham
*Attorney, Agent, or Firm*—Howard M. Cohn

[57] ABSTRACT

Apparatus and methods for spraying an adhesive onto a substrate moving along a surface with a plurality of gun modules which are attached to individual mounting plates which in turn are secured to an adhesive and air service manifold. The gun module and movable plate assemblies can be mounted to the service manifold in a manner that enables the gun module and moveable plate assemblies to be individually shifted to a plurality of preset locations in a direction parallel to the moving surface for changing the adhesive pattern sprayed onto the substrate.

16 Claims, 4 Drawing Sheets

ADHESIVE SPRAY GUN SYSTEM WITH INDIVIDUALLY ADJUSTABLE SPRAY MODULES

FIELD OF THE INVENTION

This invention relates to the field of adhesive spray guns, and more particularly, to a spray gun device for spraying an adhesive unto a substrate moving through a horizontal plane including one or more spray gun modules which are adjustably secured via individual mounting plates to a service manifold supplying operating air and molten adhesive fluid through the mounting plate to the gun modules. The mounting plate can be laterally adjusted parallel to the horizontal plane so that the gun modules can be quickly and easily aligned to a plurality of preset positions for changing the pattern of the adhesive spray to accommodate different applications.

BACKGROUND OF THE INVENTION

Equipment for applying viscous liquids, such as molten adhesives, and especially such equipment as that used to apply beads, ribbons or small unitary deposits of the extruded adhesive in a desired pattern under high-speed production conditions, is commonly used for applying molten adhesives to varying materials. These materials include flat sheets of paper or cardboard used in packaging, nonwoven fibrous material and polyethylene substrates in articles such as disposable diapers, and in other sealing applications for a variety of products.

One particular type of adhesive, generally termed "hot melt", is often used where there is a need for very short set up time between the application of the adhesive and the bonding together of the parts being adhered together. Typical hot melt adhesives, such as thermoplastic adhesives, are relatively viscous and are pumped through the nozzle of a spray gun module for application to the surface being sprayed in the form of a continuous bead or as intermittent unitary deposits.

In many high-speed packaging applications, the plurality of continuous beads or intermittent unitary deposits of molten adhesive are simultaneously applied to moving sheets of material through a number of spray gun modules, as discussed in U.S. Pat. No. Re. 27,865 assigned to Nordson Corp., the assignee of the present invention, which patent is incorporated in its entirety herein.

A principal disadvantage of this type of equipment has been the time consuming setup and adjustment procedure required at periodic intervals. When the number of gun modules and the lateral spacing between the beads of adhesive require changing or repositioning for different applications, the individual spray gun modules have to be removed and replaced on the fixed service manifold which receives the supply lines for a molten adhesive fluid and the operating air, as in the case of the U.S. Pat. No. Re. 27,865 patent. This procedure is quite time consuming and requires the interruption of the continuous production facility at frequent intervals. Also, only the angular position of the individual modules could be adjusted in the U.S. Pat. No. Re. 27,865 patent and each adjustment was independent of the adjustment of an adjacent module. Therefore, the setup and accurate alignment of the modules was still a time consuming procedure. Moreover, repositioning the modules by an angular adjustment, changes the spacing from the substrate being sprayed and affects the spray pattern of the adhesive. Further, when the spray is aligned with respect to the surface being sprayed at an angle other than ninety degrees, the swirl pattern changes, as compared with the swirl pattern which is delivered by a spray module positioned at a ninety degree angle to the sprayed surface.

U.S. Pat. No. 5,265,800 assigned to Nordson Corp., the assignee of the present invention, which patent is incorporated in its entirety herein, relates to a gun module secured to individual movable plates which in turn are secured to a transition plate attached to a service manifold. While this patent discloses an effective system to overcome some of the limitations of the U.S. Pat. No. Re. 27,865 patent, there is still a need to provide a system where the gun module and movable plate assemblies can be quickly and accurately repositioned and aligned to change the adhesive spray pattern for different applications.

OBJECTS AND SUMMARY OF THE INVENTION

It is an object of the present invention to attach one or more spray gun modules having a preset range of adjustment to a fixed service manifold so that the spray pattern can be quickly, easily and accurately changed for different applications to obviate the problems and limitations of the prior art systems.

It is a further object of the present invention to attach one or more spray gun modules having a range of lateral adjustment via a mounting plate to a fixed service manifold so that the number and/or position of the spray gun modules can be quickly and easily changed and aligned with respect to each other and the substrate being sprayed for different applications.

Yet another object is to attach one or more spray gun modules to individual mounting plates which themselves are attachable to a fixed service manifold so that the spray gun modules can be individually aligned and securely fastened at a plurality of preset positions corresponding to different spray patterns.

Still another object of the invention is to provide an adjustable positioning stop which abuts against the mounting plate to position the mount plate at a plurality of preset positions with respect to the service manifold.

In accordance with the invention, there is provided a system for easily, quickly and accurately changing an adhesive pattern sprayed onto a substrate moving along the path of a conveyor. The system includes a service manifold having adhesive and air passageways. A plurality of slidable mounting plates having adhesive and air passageways are slidably secured to the service manifold so that the adhesive and air passageways in the slidable mounting plates are in flow communication with the adhesive and air passageways in the service manifold when the slidable plates are mounted to the service manifold. The service manifold can include a transition plate to which the mounting plates are secured. Two or more spray gun modules with adhesive and air passageways are each adjustably mounted to individual slidable mounting plates and have nozzles in spaced relation to the plane through which the substrate travels. The adhesive and air passageways of the gun modules are in flow communication with the adhesive and air passageways of the slidable mounting plates. A tongue and groove configuration interconnects the slidable plates and the service manifold. The tongue and groove configuration extends parallel to the path of the conveyor through which the substrate moves to limit movement of the slidable mounting plates with respect to the service manifold in a direction parallel to the horizontal plane. The groove extends in a horizontal direction across a front surface of the service manifold and the tongue protrudes from a rear surface of the mounting blocks. Adjustable positioning stops are abutted against the slidable mounting plates for positioning the slidable mounting plates with respect to the service manifold to a plurality of preset locations.

Further in accordance with the invention, a manifold having an air passageway therethrough is securely mated against the mounting plate whereby the air passageway of the manifold is in flow communication with a second air passageway through the mounting plate which in turn is in flow communication with nozzle attachments on the spray gun modules.

Also according to the invention, a method of assembling an apparatus for spraying an adhesive onto a substrate moving along the path of a conveyor, includes the following steps. Gun modules having adhesive and air passageways are securely mounted to slidable mounting plates with adhesive and air passageways so that the adhesive and air passageways through the mounting plates are in flow communication with the adhesive and air passageways through the gun modules. The slidable mounting plates are loosely mounted to a service manifold having adhesive and air passageways therethrough. Positioning stops are rotated to a preset location and the slidable mounting plates are slid in a direction parallel to the path of the conveyor to abut against the positioning stops at one of a plurality of preset locations so that the adhesive and air passageways through the service manifold are in flow communication with the adhesive and air passageways through the mounting plate. Then the mounting plate is firmly secured to the service manifold. During the initial setup, the position of each of the gun modules is adjusted with respect to each other so that a centerline through each of the guns modules is perpendicular to the path through which the conveyor traverses.

BRIEF DESCRIPTION OF THE DRAWINGS

The structure, operation, and advantages of the presently preferred embodiment of the invention will become further apparent upon consideration of the following description taken in conjunction with the accompanying drawings, wherein.

DETAILED DESCRIPTION OF THE INVENTION

Figure 1:
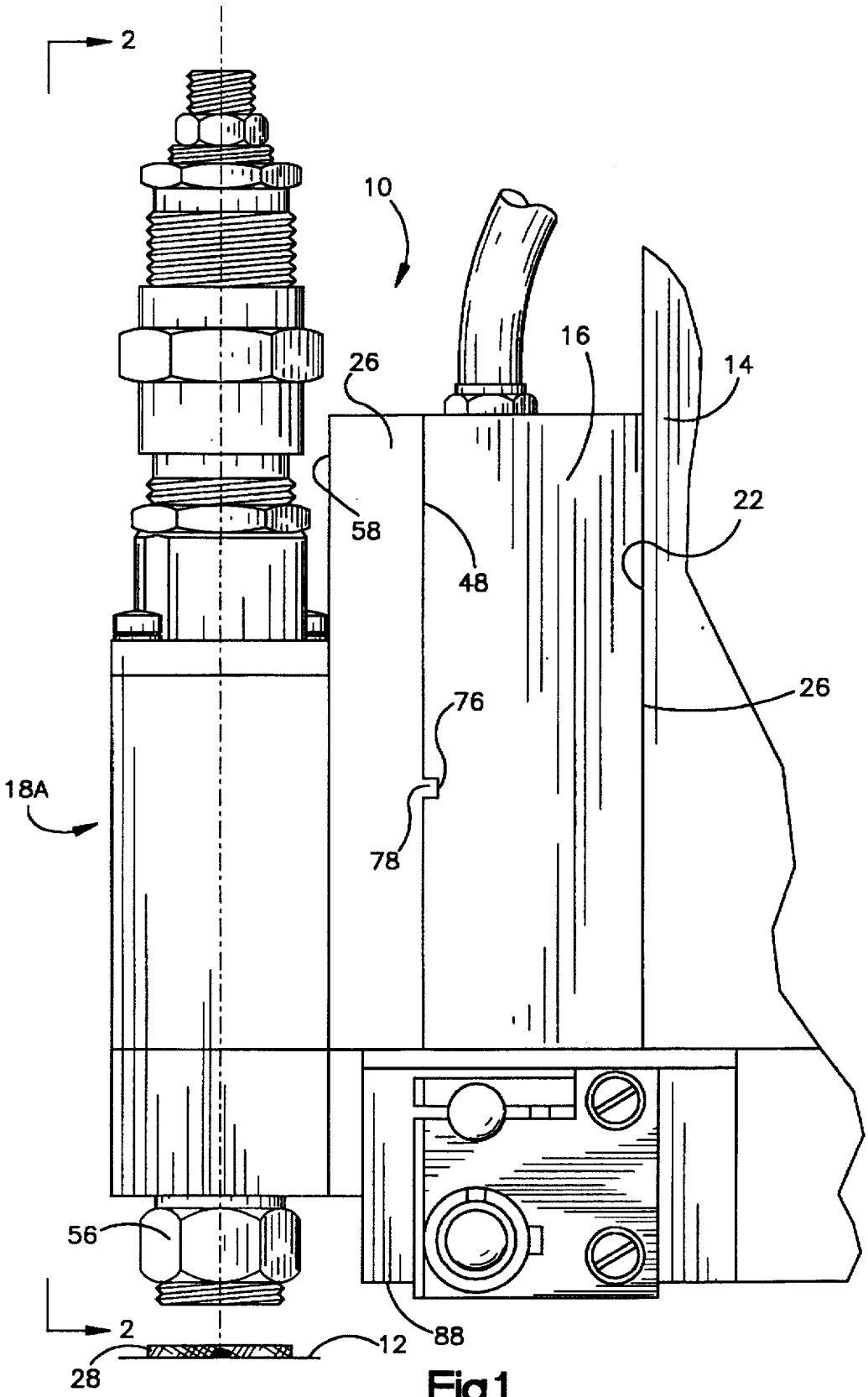
FIG. 1 is a side view of a spray gun module secured to a mounting plate which in turn is movably attached to a service manifold through an intermediate transition plate in accordance with the invention.
Figure 2:
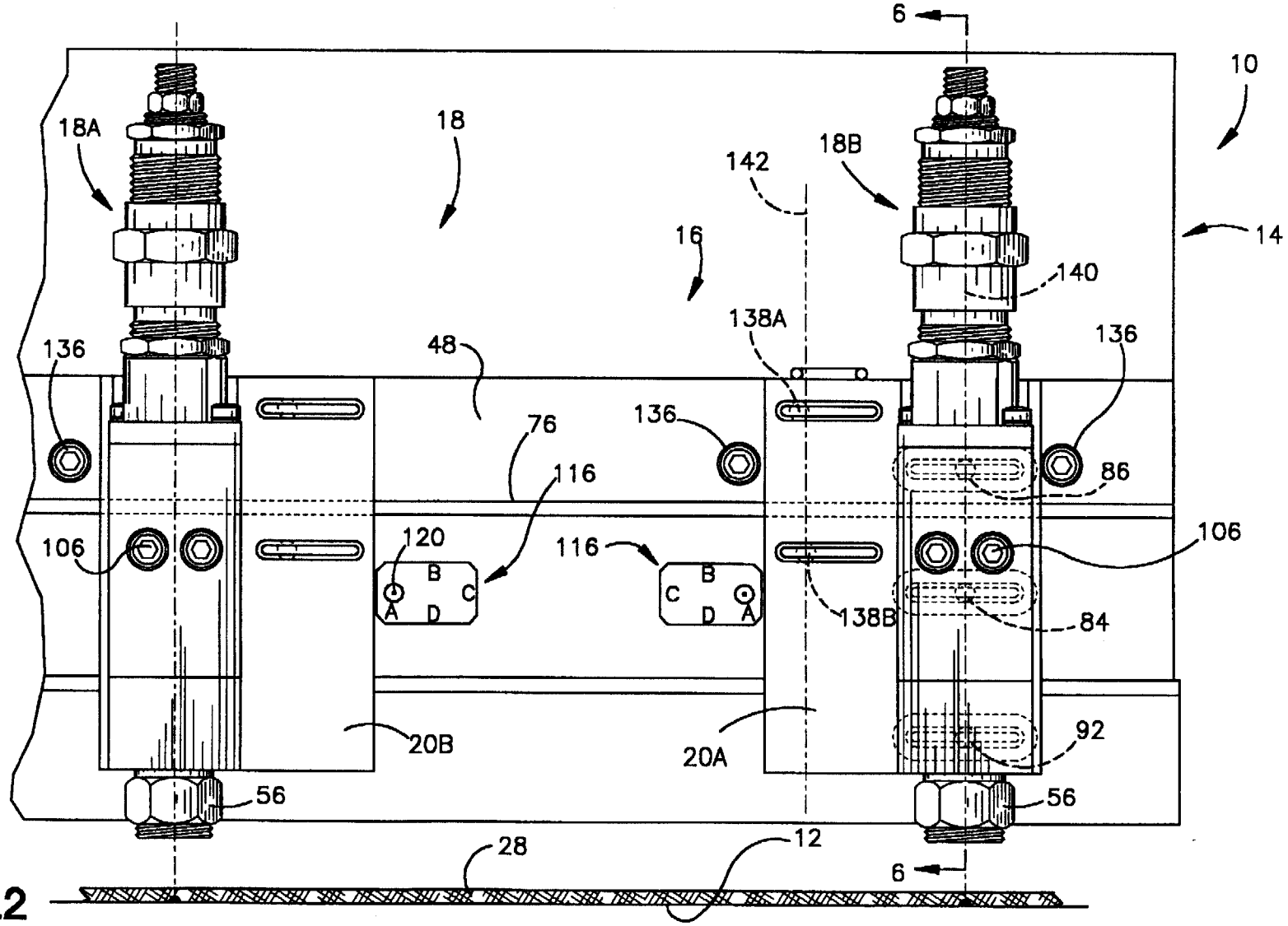
FIG. 2 is a view taken along line 2—2 of FIG. 1 illustrating spaced spray gun modules secured to individual mounting plates which in turn are attached by the intermediate transition plate to the service manifold.
Figure 6:
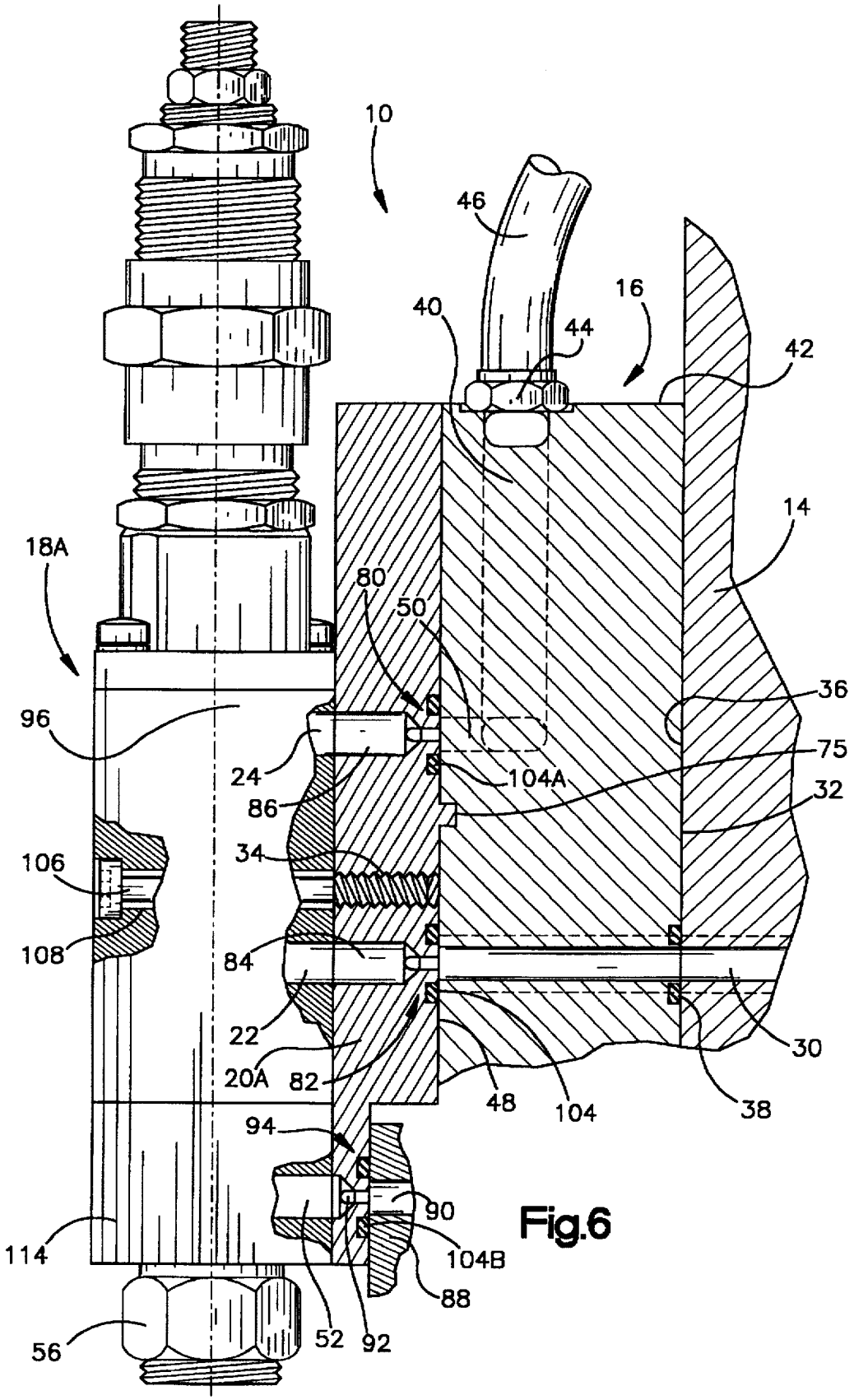
FIG. 6 is a side view, partly in cross section, of the spray gun module and mounting plate assembly attached to the service manifold through an intermediate transition plate, as illustrated in FIG. 1.

Referring to the drawings, FIGS. 1, 2 and 6 show an adhesive spray apparatus 10 embodying the invention and adapted for use in connection with equipment for delivering hot-melt type adhesive to a plurality of locations on a moving surface 12 such as a conveyor belt. While conveyor surface 12 is shown for convenience as moving through a horizontal plane, it is recognized that the conveyor can be an in-line conveyor or drum conveyor which traverses vertically, horizontally, at an angle therebetween or through an arcuate path. The apparatus 10 generally includes a service block manifold 14, an intermediate, removable transition plate 16 securely connected to the service block manifold, 14 and one or more spray gun modules 18A, 18B mounted to individual slidable mounting plates 20A, 20B which in turn are slidably secured to transition plate 16. The spray gun modules 18A, 18B have adhesive and air passage openings 22, 24, 52, respectively, and are arranged to simultaneously extrude a hot-melt adhesive at a plurality of locations on a substrate 28 carried through a plane by moving surface 12. Typically, the hot-melt adhesive is applied as a bead, ribbon or small unitary deposit onto a flat substrate, such as sheets of paper or cardboard or disposable diapers. While the spray gun modules are illustrated as being oriented in a vertical position to apply the adhesive below their nozzles, it is within the terms of the invention to orient the gun modules in any desired direction.

Service block manifold 14 has passageways 30 and 31 therethrough which open at a flat front surface 32 of manifold 14 to form a molten adhesive supply passage and a pressurized air supply passage for delivering molten adhesive and pressurized air to transition plate 16 and spray gun modules 18A, 18B, as discussed in more detail below.

Service block manifold 14 includes an intermediate, removable transition plate 16, as illustrated in FIGS. 1 and 6, having a molten adhesive passageway 34 and a pressurized air passage 35 therethrough. A flat rear surface 36 of transition plate 16 mates against front surface 32 of the service block manifold to provide proper registry between adhesive passageways 30 and 34 and air passageways 31 and 35. Seals 38 and 39, such as stamped teflon O-rings, can be disposed about the inlet openings of passageways 34 and 35 to insure that the hot melt and pressurized air do not leak between the mated surfaces 32 and 36. Transition plate 16 also has an air passageway 40 which can extend from an upper surface 42. An air fitting 44 is threadably received within an inlet opening (not shown) of passageway 40 and is connected by a hose 46 to a source of pressurized air (not shown). Transition plate 16 has a flat front face 48 and an air passageway 50 extending between the flat front face and the vertically extending air passageway 40 to direct operating air into spray gun modules 18A, 18B, as discussed below. While transition plate 16 is illustrated with air passageway 40 connected directly to an external source of pressurized air, it is also within the terms of the invention to provide an air passageway through the transition plate which mates with an air supply passage (not shown) through service block manifold 14 that opens to flat front surface 32, in a similar manner to that of air supply passage 31. Further, while transition plate 16 is illustrated as being a separate component, which is assembled onto service block 14 by conventional means, such as bolts (not shown), it is also within the terms of the invention to form mounting plate 20 as an integral part of service block manifold 14. In either case, transition plate 16 is considered to be a portion of service block 14.

A principle feature of this invention is the construction of a means 54 for accurately positioning gun modules 18A, 18B in relation to each other while simultaneously insuring that flat, bottom sides 55A, 55B of nozzles 56A, 56B of gun modules 18A, 18B, respectively, are in the same horizontal plane which in turn is parallel to the plane through which conveyor surface 12 traverses when transition plate 16 and the mounting plate and gun mounting assemblies 61 and 63, i.e., mounting plates 20A, 20B with gun modules 18A, 18B, respectively, are in an assembled condition.

Figure 4:
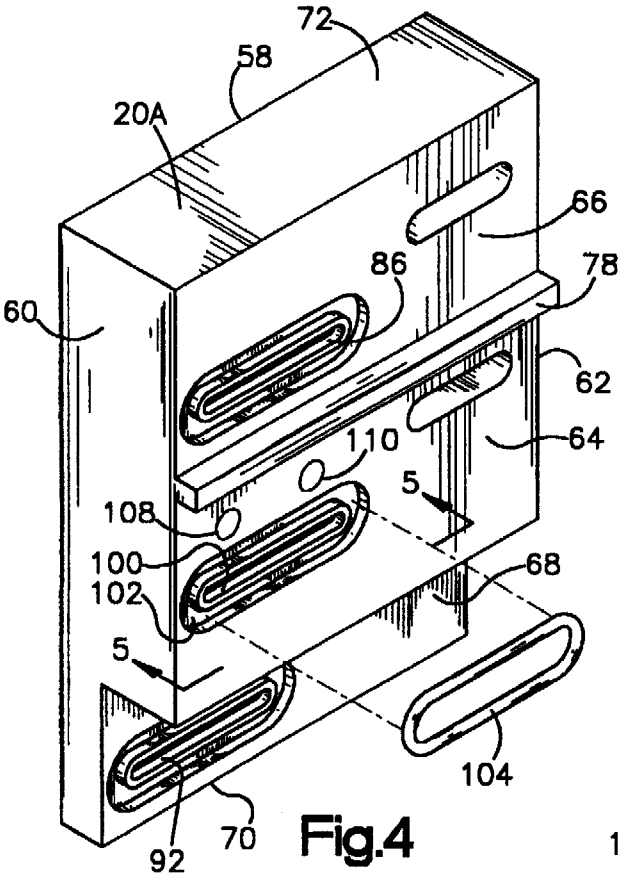
FIG. 4 is a rear perspective view of the mounting plate illustrated in FIG. 3 for attaching a spray gun module to the transition plate.

Means 54 for adjusting the lateral position of the gun modules 18A,18B relative to transition plate 16 includes slidable mounting plates 20A, 20B, as illustrated in FIGS. 1, 4 and 6. Mounting plates 20A and 20B are substantially identical except for their mounting slots 79 and 81 being on opposite sides of the plates, as shown in FIG. 2. For the purpose of describing the invention, only mounting plate 20A as shown in FIGS. 2, 3, 4 and 6 will be discussed. However, it is understood that the plate 20B has the same construction as plate 20A except for the location of the mounting slots. Moreover, depending on the application or set up of the particular system, both mounting plates could be identical.

Mounting plate 20A is a generally rectangular block with a generally rectangular, flat front surface 58, oppositely disposed, flat parallel side surfaces 60 and 62, and a rear surface 64. Mounting plate 20A also has a bottom surface 70 and a top surface 72 extending between front surface 58 and upper rear surface 66, as discussed in more detail below.

An important aspect of the invention is a tongue and groove connection 75 between mounting plate 20A and transition plate 16. Referring to FIGS. 1, 2 and 6, the positioning means 54 includes a tongue and groove configuration 75 including a slot 76 shaped to receive a tongue 78. The groove 76 extends horizontally across the length of front surface 48 of transition plate 16 and preferably has a rectangular cross section as shown in FIG. 2. Tongue 78, which projects outward from the rear surface 64 of mounting plate 20, preferably has a rectangular shape and is slidably received within groove 76 so that mounting plate 20A can slide back and forth with rear surface 64 mated against the flat forward surface 48 of transition plate 16. After assembly, both tongue 78 and groove 76 are aligned parallel to the plane through which surface 12 travels so that the bottom surfaces 55A, 55B of nozzles 56A, 56B, respectively, are equidistant from the surface 12. While groove 76 is formed in front surface 48 of the transition plate 16 or on the surface of the service manifold 14 (not shown), it is also within the terms of the invention to provide the groove in the rear surface 64 of the mounting plate 20A and to provide a tongue projecting outward from the front surface of the transition plate or the service manifold.

Another feature of the invention is the seal means 80, 82, and 83 which form fluid and air tight seals between molten adhesive and air passageways 34, 50 and 35 of transition plate 16 and the molten adhesive and air passageways 84, 86, and 92, respectively, through mounting plate 20A. Since the passageways 86 and 92 through plate 20 are essentially identical in construction, except possibly for their dimensions, only passageway 86 is next described in detail.

As illustrated in FIGS. 3, 4, 5, and 6, passageway 84 has an outlet section 96 formed of a circular, elongated bore with an outlet at the front surface 58 of mounting plate 20. An intermediate section 98, having a slot-like shape, directly adjoins outlet section 96. An elliptical oblong shaped, inlet section 100 directly adjoins the intermediate section 98. The width of inlet section 100 determines the range of distance for lateral adjustment of movable plate 20A with respect to transition plate 16 on which it is assembled. Therefore the width of inlet section 100 must be equal to or less than the lateral width of slot shaped throughbores 79 and 81 which receive the attachment bolts 138A, 138B, respectively, to assemble mounting plate 20A, 20B to transition plate 16. In addition, the slot shaped throughbores 79 and 81 are dimensionally positioned with respect to slot shaped openings 100 so that when mounting plate 20A reaches the end of its travel in either direction, the end of inlet section 100 is in registry with the air or adhesive passageway in transition block 16 and the end of slot shaped openings 79 and 81 are abutted against mounting bolts 139A and 139B.

Figure 5:
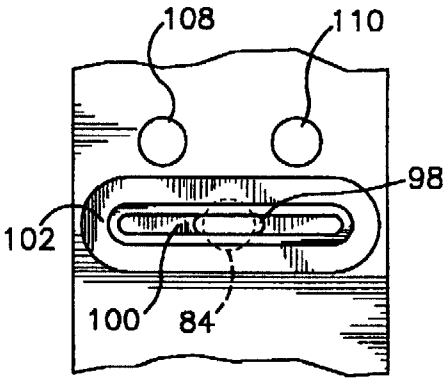
FIG. 5 is a view taken along line 5—5 of FIG. 4 illustrating seals in a slot shaped opening about adhesive and air passageways formed in the mounting plate.

As shown in FIG. 5, a slot shaped opening 102 with bounded ends is disposed about inlet opening 100 to receive a seal element 104B such as the stamped teflon O-ring, illustrated in FIG. 4. O-ring 104B is pressed into the groove 102 and projects outward from rearward facing surface 64 so as to compress against the front surface 48 of transition plate 16 and form a fluid or air tight seal around the registered passageways 34 and 84 of the transition plate and the mounting plate 20A, respectively. As shown in FIG. 6, the air passageways 86 and 92 also have seal elements 104A and 104C, respectively, disposed in their corresponding slot shape openings to provide a seal between the transition and mounting plates.

The spray gun modules 18A, 18B are securely mounted onto separate slidable mounting plates 20A and 20B, respectively, with threaded bolts 106 that are threadably received in threaded throughbores 108 and 110 in the mounting plates 20A, 20B. Each spray gun module 18A, 18B has two bore holes 112 and 114 through which attachment bolts 16 extend and which are larger than the diameter of the body of bolt 16, as shown in FIG. 6, and have a countersunk portion to receive the head of the bolt. The diameter of bore holes 112, being larger than the diameter of attachment bolts 16, allow each spray module to be accurately positioned on the mounting plates as discussed below. While two spray gun module and movable plate assemblies 61 and 63 are illustrated, it is within the terms of the invention to provide three or more spray gun module and movable plate assemblies as desired.

While the illustrated embodiment includes a pressurized air passageway 31 from service manifold 14 through passage 35 in transition plate 16 and into passage 92 on mounting plate 20A for delivery to nozzle attachment 114, it is also within the terms of the invention to provide a separate air manifold which is securely mated against the lower rear surface portion of mounting plate 20A and provide pressurized air through passageway 92 to a nozzle attachment 114 on spray gun modules 18A, 18B as discussed in U.S. Pat. No. Re. 33,481 assigned to Nordson Corp., the assignee of the present invention, which patent is incorporated in its entirety herein. While the illustrated embodiment includes the air passageway 92 for delivering air to the nozzle attachment 114 on gun module 18A, it is within the scope of the invention to provide a mounting plate without provisions for directing air to the nozzle attachment 114.

Figure 7:
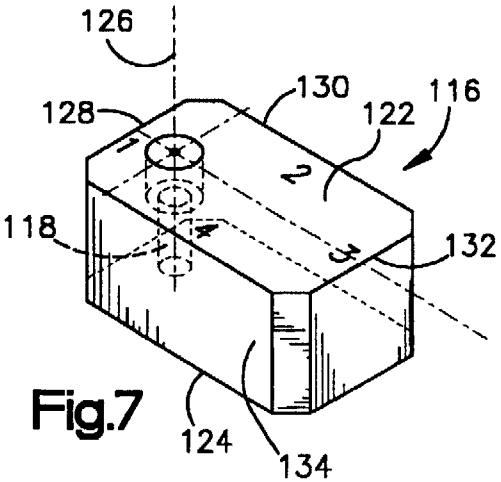
FIG. 7 is a perspective view of an adjustable positioning stop.

An important aspect of the present invention relates to indexing positional stops 116A, 116B, as shown in FIGS. 2 and 7, which determine the position of the mounting plates 20A, 20B on the transition plate 16. The positional stops 116A, 116B are block shaped elements with a throughbore 118 which receives a bolt 120 to pivotally secure the positional stops to transition plate 16. In a typical embodiment, bore 18 extends from the top surface 122 to the bottom surface 124 of the block element. Bore 118 can be countersunk at its upper end to receive a bolt head and allow the positional stop to rotate about axis 126 which extends vertically through the bore 118. In the preferred embodiment, the distance from center line 126 to the four side walls 128, 130, 132, and 134 is four different dimensional values. However, it is within the terms of the invention to provide a positional stop with a different number of sides such as 3, 5, 6, or 8. Further, the positional stops could be constructed with a cylindrical shape with the desired positions clearly marked on the top surface 122.

As shown in FIG. 2, positional stops 116A, 116B are mounted onto transition plate 16 adjacent to a side wall of mounting plates 20A, 20B, respectively. By turning the positional stop 116 so that one of its side walls designated A, B, C, or D is abutted against a side surface 62 of mounting plate 20A, the mounting plate and the spray module 18A secured thereto can be accurately positioned at a predetermined location. When a different spray setting is required, stop 116A can be quickly and easily rotated about axis 126, to a different position such as B, C, or D. The effect is to relocate spray module 18A to a different predetermined position with respect to transition plate 16. It is important that the dimensions of the positional stops 116A, 116B, i.e, the distance from centerline 126 to the side walls 128, 130, 134 designated as A, B, C, D, respectively, be selected so that the passageways 50, 34 and 90 remain within the boundaries of O-rings 104A, 104B, and 104C, respectively, to prevent leakage between the transition and movable plates 16 and 20A, respectively.

To assemble and align the adhesive spray apparatus 10, gun modules 18A, 18B are loosely secured onto mounting plates 20A, 20B by means such as threaded bolts 106. The mounting plates 20A, 20B with the attached gun modules 18A, 18B are then placed at one side of transition plate 16 which was previously secured to service block manifold 14 by conventional means such as bolts 136. Next, the assembler grasps the spray gun module and mounting plate assemblies 61 and 63 and attaches them onto the transition plate 16 so that tongue 78 is located within groove 76. Bolts 138A, 138B are next inserted through slots 79 and 81, respectively, and secured to the transition plate 16 so that the mounting plates are loosely mounted to the transition plate. Once the gun modules 18A, 18B are located at their approximate desired position relative to the adhesive and air passageways 34, 50, and 90, the positional stops 116A, 116B are set at a predetermined position to align nozzles 56A, 56B with respect to each other and with the surface 12. The mounting plates 20A, 20B are then pressed against the positional stops 116A, 116B and bolts 138A, 138B are tightened. Finally, the bolts 105 are tightened to secure gun modules 18A and 18B to mounting plates 20A and 20B, respectively.

An important aspect of the assembly relates to the alignment of nozzles 56A, 56B with respect to the surface 12. This is particularly important when the nozzles are slot nozzles which contact the substrate onto which the adhesive is applied. The bottom surface 55A and 55B of the nozzles must be accurately positioned with respect to both the surface of the substrate and to each other so that they are not so close to the substrate so as to gouge into and rip the substrate or not so far so as to apply adhesive in the wrong location or with the wrong pattern on the substrate. Due to manufacturing tolerances, such as the tongue and groove connection 75 or the mounting holes 108,110 for attaching the spray module to the mounting plate might be slightly skewed so that the bottom, flat surfaces 55A, 55B of nozzles 56A, 56B are slightly out of alignment with each other. Therefore, prior to tightening bolts 106 and securing the gun modules 18A, 18B to mounting plates 20A, 20B, a straight edge is placed against the bottom, flat surfaces 55A and 55B of nozzles 56A and 56B, respectively, and the gun modules 18A, 18B are aligned so that the bottom surfaces are both flat against the straight edge. Then the bolts 106 are tightened and the gun modules are aligned with respect to each other so as to eliminate problems caused by inaccuracies in the manufacturing tolerances of the gun modules or the mounting plates, as previously discussed.

Figure 3:
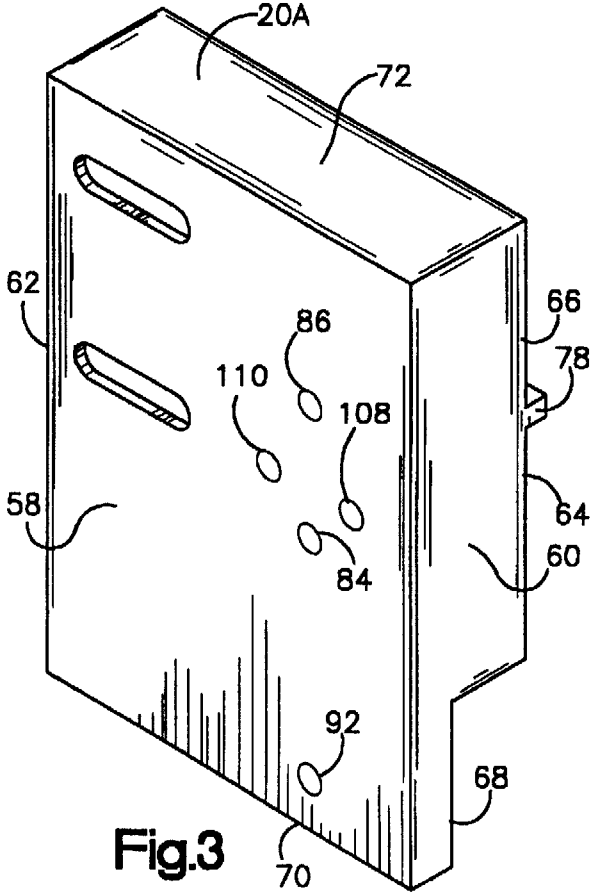
FIG. 3 is a front perspective view of a mounting plate for attaching a spray gun module to the transition plate.

An important feature of the invention is that the vertical centerlines 140A, 140B through the outlets of passageways 86, 84, and 92, as shown in FIGS. 2 and 3, are parallel with the centerlines 142A, 142B through the threaded bores in transition plate 16 containing bolts 138A, 138B. Then, the gun modules 18A, 18B on mounting plates 20A, 20B, respectively, can be slid or shifted back and forth with respect to each other, without angular movement, for exact positioning of nozzles 56A, 56B with respect to surface 12. Also, the location of the centerlines 140A, 140B through the outlets of passageways 86, 84 and 92 are at a predetermined distance from the centerlines 142A and 142B through the threaded bores 138A, 138B to provide the maximum range of adjustment of movable plates 20A, 20B with respect to transition plate 16. This design feature is necessary to ensure that the passageways 86, 84, and 92 are in flow registration with passageways 50, 34, 90, irrespective of the placement of movable plates 20A, 20B with respect to transition plate 16. That is, the extent or range of the lateral movement of the gun module and mounting plate assemblies 61, 63 across the length of transition plate 16 is limited by the width of the oblong shaped inlet section of passageways 86, 84, and 92 through mounting plates 20A, 20B. The passageways 86, 84 and 92 must be located within the inner perimeter of seal rings 104A, 104B, 104C, respectively, so that no leakage occurs between the mated front surface 48 of transition plate 16 and the upper and the rear surfaces 64 of the mounting plate 20A, 20B.

Once the gun modules 18A, 18B are in a predetermined position, bolts 138A and 138B are each sufficiently tightened to press together the mating surfaces 48 and 64 of transition plate 16 and mounting plates 20A, 20B, respectively, so that the O-rings 104A, 104B, 104C are compressed therebetween to form fluid-tight and air-tight seals around the adhesive and air passageways about which they are located.

After the adhesive spray device 10 is set up and operating, it can be easily readjusted by simply loosening the bolts 138A, 138B securing the mounting plates 20A, 20B, to transition plate 16. Then, the stop blocks 116A, 116B are moved to a desired position so that a desired side wall designated by A, B, C, or D is facing the side surface of the mounting blocks. Finally, one or more of the gun modules 18A, 18B is moved to the right or left in abutting relation to block 116 and bolts 138A, 138B are tightened so that the location at which the spray is delivered onto the substrate 28 moving along surface 12 is at a predetermined location.

It is apparent that there has been provided in accordance with this invention apparatus and methods for attaching spray modules to a fixed service manifold so that the spray pattern from each of the spray gun modules can be easily and quickly changed to another predetermined pattern. This is accomplished by a tongue and groove connection in combination with a positioning block to ensure that the position of spray gun modules can be quickly and easily changed and laterally aligned with respect to each other. Further, the spray gun modules can be securely fastened to provide fluid tight seals about the air and adhesive passageways and to prevent the spray gun modules from moving out of alignment from a desired position.

While the invention has been described in combination with embodiments thereof, it is evident that many alternatives, modifications, and variations will be apparent to those skilled in the art in light of the foregoing teachings. Accordingly, the invention is intended to embrace all such alternatives, modifications and variations as fall within the spirit and scope of the appended claims.

We claim:

1. A system for changing an adhesive pattern sprayed onto a substrate moving through a path of a conveyor, comprising:

a service manifold having adhesive and air passageways;

a slidable mounting plate having adhesive and air passageways, said slidable plate being slidably secured to said service manifold so that said adhesive and air passageways in said slidable mounting plate are in flow communication with said adhesive and air passageways in said service manifold when said slidable mounting plate is mounted to said service manifold;

at least one spray gun module with adhesive and air passageways adjustably mounted to said slidable mounting plate and in spaced relation to said path of said conveyor through which said substrate travels, said adhesive and air passageways of said at least one gun module being in flow communication with said adhesive and air passageways of said slidable mounting plate;

a tongue and groove configuration interconnecting said slidable plate and said service manifold, said tongue and groove configuration extending parallel to said path through which said substrate moves to limit movement of said slidable mounting plate with respect to said service manifold in a direction parallel to said path; and an adjustable positioning stop abutted against said slidable mounting plate for positioning said slidable mounting plate with respect to said service manifold at a plurality of preset locations.

2. The apparatus of claim 1 wherein said tongue and groove configuration includes a groove extending in a horizontal direction across a front surface of said service manifold and a tongue protruding outward from a rear surface of said mounting plate, said tongue being slidably received in said slot.

3. The apparatus of claim 2 wherein said groove has a rectangular cross section and said tongue has a rectangular shape which is slidably received in said slot.

4. The apparatus of claim 2 wherein said service manifold includes a transition plate with adhesive and air passageways securely connected thereto, said adhesive and air passageways of said transition plate are in flow communication with said adhesive and air passageways of said service manifold, and said slidable mounting plate is slidably mounted to said transition plate by said tongue and groove configuration.

5. The apparatus of claim 4 wherein said mounting plate has two parallel, oblong shaped throughbores through which mounting bolts are received to attach said mounting plate to said transition plate, said oblong shaped throughbores being of a predetermined length which determine the distance of lateral travel said mounting plate can move with respect to said transition plate.

6. The apparatus of claim 5 wherein inlet sections of said adhesive and air passageways of said mounting plate each include a slot shaped opening with bounded ends which is in flow communication with said adhesive and air passageways of said transition plate.

7. The apparatus of claim 6 wherein each said slot shaped opening is no wider than said oblong shaped throughbores.

8. The apparatus of claim 7 including a seal in each said slot shaped opening with bounded ends for forming a fluid or air tight seal between said molten adhesive and air passageways of said transition plate and said molten adhesive and air passageways of said mounting plate irrespective of the relative position of said molten adhesive and air passageways of said transition plate to said molten adhesive and air passageways of said mounting plate.

9. The apparatus of claim 8 wherein said seal is an O-ring disposed in each said slot shaped opening which is compressed between said transition plate and said mounting plate.

10. The apparatus of claim 1 wherein said adjustable stop is a block shaped element which is rotatably secured to said transition plate.

11. The apparatus of claim 10 wherein said block shaped element is a rectangular shaped block with a throughbore receiving a bolt to secure said block shaped element to said transition plate, said throughbore having an axis extending therethrough which is spaced a different distance from each side of said rectangular shaped block.

12. The apparatus of claim 4 further including a second air passageway in said service manifold in flow communication with a second air passageway through said mounting plate which in turn is in flow communication with a nozzle attachment on said at least one spray gun module.

13. The apparatus of claim 12 including a seal in a slot shaped opening with bounded ends about an inlet section of said second air passageway of said mounting plate for forming an air tight seal between said second air passageway of said service manifold and said second air passageway of said mounting plate irrespective of the relative position of said second air passageway of said service manifold to said second air passageway of said mounting plate.

14. The apparatus of claim 13 wherein said seal comprises an O-ring which is disposed in said slot shaped opening about said inlet section of said second air passageway through said mounting plate which is compressed between said service manifold and said mounting plate.

15. The apparatus of claim 1 including a plurality of gun modules and a plurality of mounting plates, each of said gun modules mounted on individual mounting plates which are slidably attached to said transition plate.

16. The apparatus of claim 1 wherein said transition plate is removably attached to said service manifold.

* * * * *